United States Patent [19]

Brown

[11] 4,348,789

[45] Sep. 14, 1982

[54] SLIDE FASTENER WITH IMPROVED CLAMPS AND METHOD OF MANUFACTURE

[75] Inventor: Robert H. Brown, Meadville, Pa.

[73] Assignee: Talon, Inc., Meadville, Pa.

[21] Appl. No.: 204,119

[22] Filed: Nov. 4, 1980

[51] Int. Cl.[3] ..... A44B 19/04; A44B 19/32

[52] U.S. Cl. ..... 24/205.1 R; 24/205.16 R

[58] Field of Search ..... 24/205.1 R, 205.13 R, 24/205.16 R; 29/408, 410

[56] References Cited

U.S. PATENT DOCUMENTS

| | | | |
|---|---|---|---|
| 2,775,012 | 12/1956 | Mulka | 24/205.1 R |
| 2,791,017 | 5/1957 | Mulka | 24/205.1 R |
| 2,800,157 | 7/1957 | Mulka | 29/33.2 |
| 2,928,156 | 3/1960 | Doelter et al. | 24/205.1 R |
| 3,005,247 | 10/1961 | Doelter | 24/205.1 R |
| 3,030,683 | 4/1962 | Doelter | 24/205.1 R |
| 3,167,834 | 2/1965 | Schmiele | 24/205.1 R |
| 4,275,467 | 6/1981 | Doelter | 24/205.1 R |

FOREIGN PATENT DOCUMENTS

| | | | |
|---|---|---|---|
| 648172 | 9/1962 | Canada | 24/205.1 R |
| 1011822 | 9/1957 | Fed. Rep. of Germany | 24/205.1 R |
| 1042491 | 11/1958 | Fed. Rep. of Germany | 24/205.1 R |

*Primary Examiner*—Paul J. Hirsch

*Attorney, Agent, or Firm*—Anthony A. O'Brien

[57] ABSTRACT

In a slide fastener employing coupling elements secured within folds of supporting tapes by clamps secured over the folds, clamp legs are formed with raised land areas and lips for cooperating with flange edges and upper surfaces of bases of the elements, and the inside surfaces of heels of the clamps are formed flat for cooperating with bottom surfaces of the elements to accurately position the elements relative to the clamps. Reduced thickness of the junctions between legs and heels relative to the thickness of central portions of the legs and heels produces corners receiving displaced tape material from between the raised land areas of the legs and the outer edges of flanges of the coupling element as well as from between the bottom surfaces of the bases of the coupling elements and the flat inner surfaces of the heels.

8 Claims, 7 Drawing Figures

FIG. 1
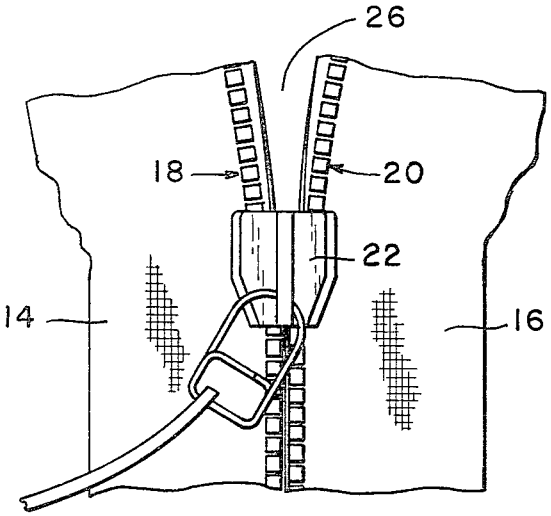
FIG. 2
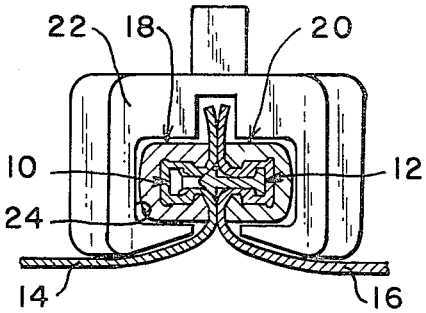
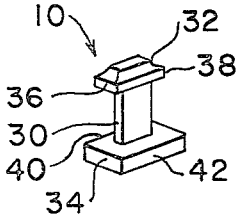
FIG. 3
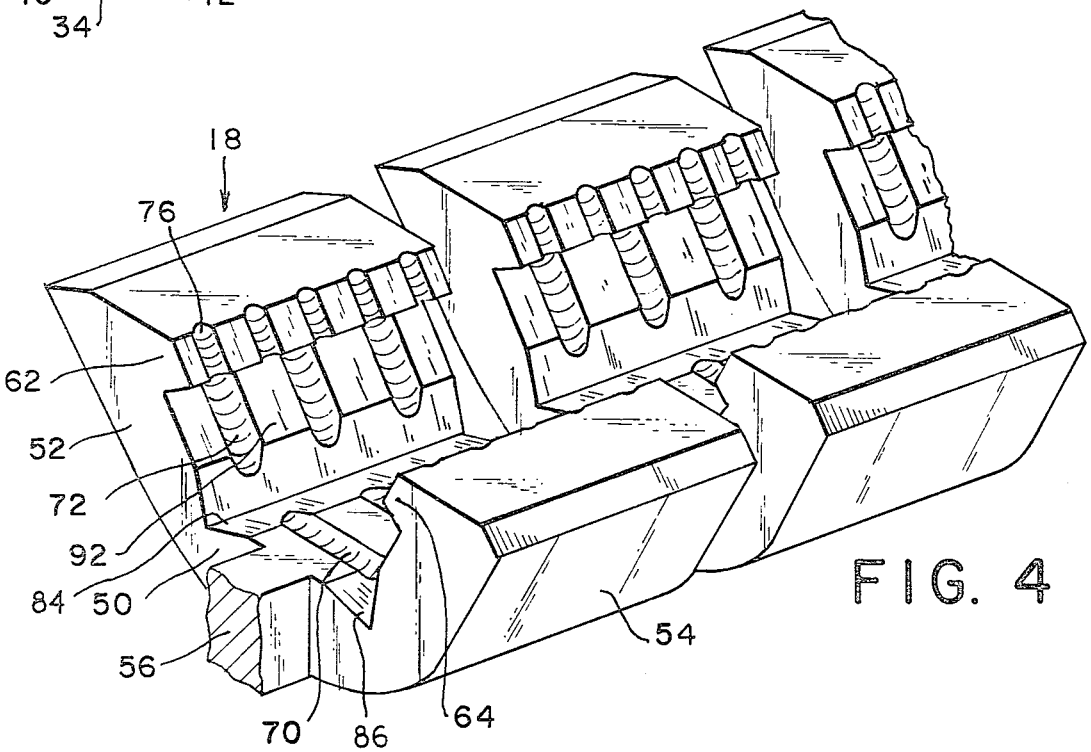
FIG. 4

SLIDE FASTENER WITH IMPROVED CLAMPS AND METHOD OF MANUFACTURE

TECHNICAL FIELD

The present invention relates to slide fasteners and methods of manufacture wherein clamps are employed to secure rows of coupling elements within folds of supporting tapes or members.

DESCRIPTION OF THE PRIOR ART

The prior art, as exemplified in U.S. Pat. No. 2,775,012, No. 2,791,017, No. 2,800,157, No. 2,928,156, No. 3,005,247 and No. 3,030,683, contains several slide fasteners employing rows of coupling elements secured within folds of supporting tapes or members. Clamps extending over the outside of each fold secure respective elements of a row of coupling elements within the fold. This type of slide fastener is particularly useful for slide fasteners which form closures sealed against water, gas or dust by holding portions of non-porous tapes or edges of article portions together in sealed engagement. The clamps have a general U-shape with inward extending lips or flanges on the upper edges of legs of the clamps for engaging the tapes to secure the tapes folded around base portions and against shanks extending from the base portions of the coupling elements. Inner surfaces of the clamps may be roughened by knurling or serations to more securely hold the tapes. In the manufacture of prior art slide fasteners, the clamps were sometimes distorted or otherwise mismatched with the shape of the coupling elements causing leaks or failure of the fastener. Further prior art apparatuses for bending and securing the clamps on the folds were often subject to excessive workload and wear resulting in distortion of clamps and high maintenance costs.

SUMMARY OF THE INVENTION

The invention is summarized in a slide fastener chain including a pair of rows of spaced coupling elements; each coupling element having a shank, a head on one end of the shank for interlocking with heads of the opposite row of coupling elements, and a base on the other end of the shank forming flanges protruding perpendicularly from opposite sides of the shank; each base defining a bottom surface, a pair of opposite outer flange edges, and upper flange surfaces disposed towards the respective head; a pair of tape-like flexible supporting portions defining an opening therebetween and having respective inner portions folded around the bases and over the shanks of the respective rows of coupling elements with the head portions protruding from the folded portions; a pair of rows of clamps corresponding to the coupling elements and secured on the outside of the folded portions of the supporting portions to secure the folded portions on the bases and shanks of the corresponding coulpling elements; each clamp having a heel engaging the respective folded portion against the bottom surface of the corresponding base, and having a pair of legs extending from opposite sides of the heel over opposite sides of the respective folded portion and engaging the respective folded portion with the outer flange edges and with the opposite sides of the shanks of the corresponding coupling element; each pair of legs having respective lips extending inward toward intermediate portions of the opposite sides of the shanks, and having land areas raised toward the respective outer flange edges for positioning the corresponding clamp relative to each coupling element in directions perpendicular to the opposite sides of the shank; each lip having a lower inner surface facing the respective upper flange surface, and each heel having a flat inner surface for positioning the corresponding clamp relative to each coupling element in directions parallel to the shank; and each of the heel and the pairs of legs defining junctions therebetween having substantially reduced thickness relative to central portions of the heels and the legs forming inner corners at the junctions for receiving displaced portions of the flexible supporting portions from between the bottom surface of each base and the flat inner surface of each heel and from between the raised land areas of the legs and the outer flange edges.

An object of the invention is to construct a slide fastener employing coupling elements secured within folds of a supporting member by clamps with substantially improved positioning of the coupling elements relative to the clamps.

Another object of the invention is to provide for substantially less distortion in clamps secured over folds in supporting members to hold coupling elements in the fold.

It is also an object of the invention to substantially reduce the workload, wear and breakage of machinery manufacturing slide fasteners with clamps holding couplings in folds.

One advantage of the invention is that reduced thickness formed at junctions between legs and heels of clamps results in substantially more reliable and easier bending of legs without distortion about the junctions in forming and clamping of the clamps in a slide fastener.

Another advantage of the invention is that coupling elements are held in position in directions perpendicular to shanks of the coupling elements by inner edges of lips of legs engaging a folded supporting tape against the shanks and by raised land areas on the legs engaging the folded tape against outer flange edges of bases of the coupling elements, and are held in position in directions extending parallel the shanks of the coupling elements, by flat inner surfaces of the heels of the clamps engaging tape portions over bottom surfaces of the bases of the coupling elements and by inner surfaces of the lips facing upper surfaces of the flanges of the bases of the elements.

One additional feature of the invention is that reduced thickness of a clamp at junctions between legs and a heel of the clamp produces inside corners at the junctions for receiving displaced portions of supporting material from between a bottom surface of a base of a coupling element and a flat inner surface of a heel of the clamp and from between raised land areas of the legs and outer flange edges of the base to permit accurate positioning of the elements as well as reducing stress and rupture of the supporting material.

Other objects, advantages and features of the invention will be apparent from the following description of the preferred embodiment taken in conjunction with the accompanying drawings.

BRIEF DESCRIPTION OF THE DRAWINGS

FIG. 1 is a plan view of a broken-away portion of a slide fastener constructed in accordance with the invention.

FIG. 2 is a cross-section view of the slide fastener of FIG. 1.

FIG. 3 is a perspective of a coupling element removed from the slide fastener of FIGS. 1 and 2.

FIG. 4 is an enlarged perspective view of a train of formed and partially bent clamp members prior to being installed in the slide fastener of FIGS. 1 and 2.

DESCRIPTION OF THE PREFERRED EMBODIMENT

Figure 5:
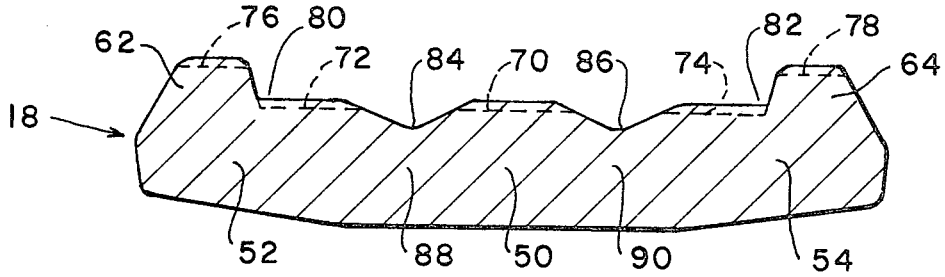
FIG. 5 is a cross-section view of a rolled wire strip prior to being stamped and partially bent into the clamp members of FIG. 4.
Figure 6:
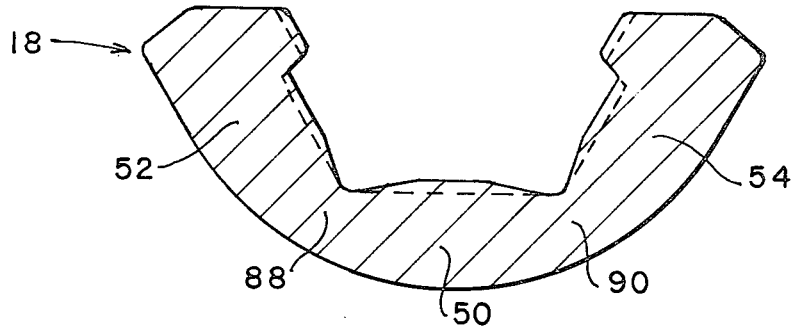
FIG. 6 is a cross-section view of a formed and partially bent clamping member in FIG. 3.

As illustrated in FIGS. 1 and 2, a slide fastener manufactured in accordance with the invention includes a pair of rows of coupling elements indicated generally at 10 and 12 and which are secured within folds of respective tapes or flexible supporting members 14 and 16 by corresponding clamps indicated generally at 18 and 20 and secured in respective rows on the outsides of the folds. A slider 22 has a Y-shaped channel 24 formed therein for slidingly receiving and engaging the rows of clamps 18 and 20 and the rows of coupling elements 10 and 12 for engaging or disengaging the coupling elements 10 and 12 to open and close an opening 26 between the supporting members 14 and 16. When the coupling elements are engaged, as shown in FIG. 2, portions of the supporting members 14 and 16 extending adjacent the coupling elements 10 and 12 and the folds in the supporting members 14 and 16 are held by the clamps 18 and 20 in firm engagement with each other to form a seal between the members 14 and 16 preventing passage of air, water or dust. As viewed in FIGS. 1 and 2, the coupling elements 10, the supporting member 14 and the clamps 18 form a left-hand stringer, and the coupling elements 12, the supporting member 16 and the clamps 20 form a right-hand stringer. Together, the left and right stringer form a slide fastener chain. Since the right-hand stringer is substantially a mirror image of the left-hand stringer, only the left-hand stringer is described in detail with respect to FIGS. 3–7.

As shown in FIG. 3, the coupling elements 10 each have a shank 30, a head 32 fixed on one end of the shank 30, and a base 34 supporting the shank 30 at its opposite end. The shank 30 is generally rectangular in cross-section to form a narrow post connecting the head 32 to the base 34. The head 32 has the shape of a plate-like rectangular member extending perpendicular to the shaft 32 and having a pointed cap formed on the top side thereof. The head 32 forms front and rear extensions 36 and 38 extending from the shank for interlocking with head extensions of coupling elements 12, FIG. 2, which are offset relative to the coupling elements 10 in a direction longitudinal to the slide fastener. The base 34 has the shape of a rectangular plate, slightly larger than the head 32, and extending perpendicular to the shank 30. Side portions 40 and 42 of the base 34 form flanges which extend perpendicular to the sides of the shank 30 and over which the tape-like portions 14 are folded.

Figure 7:
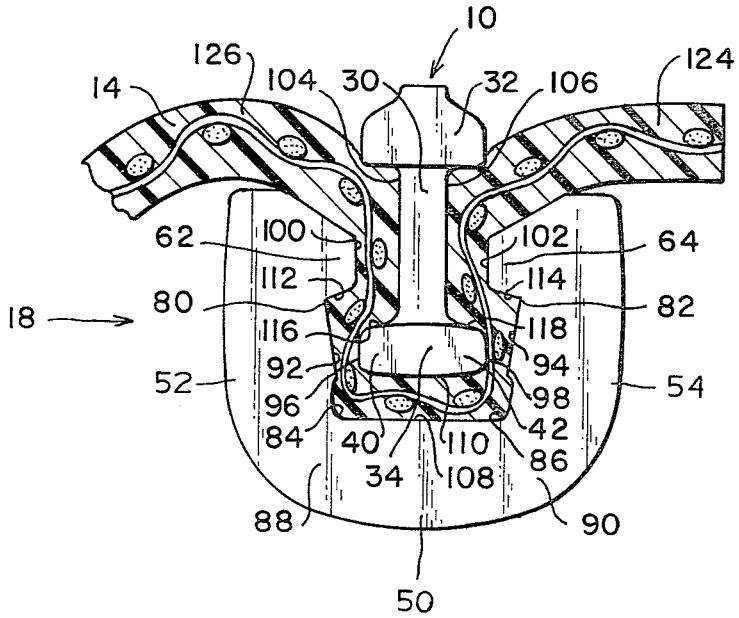
FIG. 7 is an enlarged cross-section view of a portion of the slide fastener of FIGS. 1 and 2.

As shown in FIGS. 2 and 7, the supporting portion 14 is folded around the base 34 with the folded portions extending on opposite sides of the shanks 30 and with the head 32 protruding from the fold. The supporting portions 14 may be tapes or tape-like edge portions of an article. For example, the supporting portion may be strips of rubberized fabric, as illustrated in FIG. 7.

As shown in FIG. 7, the clamps 18 have a heel 50 and a pair of legs 52 and 54 which form a U-shaped clamp. The legs 52 and 54 have respective inward extending lips 62 and 64 disposed adjacent their top edges. The initial shape of the clamp is formed during a wire rolling process to form a flat cross-section as shown in FIG. 5 wherein the rolled portions corresponding to the legs 52 and 54 extend in opposite directions from opposite sides of the heel portion 50. During the wire rolling operation, serations 70, 72, 74, 76 and 78 are formed in the inside surfaces of the heel portion 50, the leg portions 52 and 54 and the lips 62 and 64. Corners 80 and 82 are formed at the junctions between the lips 62 and 64 and the legs 52 and 54. Grooves 84 and 86, substantially longer than the serations 70, 72, 74, 76 and 80, and transverse or perpendicular to the leg portions 52 and 54 and the heel portion 50, are formed at the junction between the heel portions 50 and the respective leg portions 52 and 54 to form regions 88 and 90 of substantially reduced thickness at such junctions. Subsequently the rolled stock of FIG. 5 is subjected to a blanking and partial bending operation to form a train of the clamps 18 interconnected by connecting portions 56, FIG. 4, and with the leg portions 52 and 54 partially bent upward. During further operations the connecting portions 56 are severed from the train of clamps 18 and the clamps are clamped onto the fold in the supporting portion 14 over the corresponding elements 10 by bending the legs 52 and 54 to extend in the same direction from the opposite ends of the heel 50 to engage the legs with the fold securing the elements within the fold.

As shown in FIG. 7, the clamp 18 applied to the fold in the supporting portion 14 has its legs bent upward and inward to extend parallel to each other so that the lips 62 and 64 clamp the folded portions of the supporting member 14 around the shank 30 above the base 34. Land areas 92 and 94 on inside surfaces of the legs 52 and 54 engage the outside of the folded supporting member over outer edges 96 and 98 of the flanges 40 and 42 of the base 34, and inner surfaces 100 and 102 of the lips 62 and 64 engage outer surfaces of the folded supporting member 14 over side surfaces 104 and 106 of the shank to securely hold the coupling element 10 relative to the clamp 18 in directions perpendicular to the shank 30. The inside surface 108 of the heel 50 is formed flat and is disposed on the outside of the folded supporting member over the bottom surface 110 of the base 34, and the lips 62 and 64 have bottom inside surfaces 112 and 114 engaging the outside of the folded supporting portion over upper surfaces 116 and 118 of the flanges 40 and 42 for securing the coupling element 10 relative to the clamp 18 in directions parallel to the shank 30. The grooves 84 and 86 in the U-shaped clamp of FIG. 7 form corners receiving displaced material from the supporting member 14 from between the heel surface 108 and the base surface 110 and from between the raised surfaces 92 and 94 of the legs 52 and 54 and the edge surfaces 96 and 98 of the base 34. The corners 80 and 82 adjacent the lips 62 and 64 receive displaced material from between opposed surfaces 92 and 96, opposed surfaces 94 and 98, opposed surfaces 112 and 116, and opposed surfaces 114 and 118.

The structure of the clamp 18 cooperating with the element 10 results in substantially more reliable and accurate positioning of the coupling elements 10 relative to the clamps 18 to produce a substantially improved slide fastener. The inner raised surfaces 92 and 94 of the legs 52 and 54 cooperate with the edge surfaces 96 and 98 of the flanges 40 and 42 of the coupling element 10 to accurately position the base 34 relative to the legs 52 and 54. The inner surfaces 100 and 102 of the lips 62 and 64 cooperate with the side surfaces 104 and 106 of the shank 30 to accurately position the element 10 in parallel relationship with the legs 52 and 54 and to maintain this parallel relationship. The extent of protrusion of the head 32 is accurately determined by the cooperation of the inside surface 108 of the heel 50 with the bottom surface 110 of the base 34 together the cooperation of the inside bottom surfaces 112 and 114 of the lips 62 and 64 with the upper surfaces 116 and 118 of the flanges 40 and 42. This accurately positions the coupling element 10 and its head 32 relative to the top surfaces of the legs 52 and 54. The flat inner surface 108 together with the raised surfaces 92 and 94 on the inside of the legs 52 and 54 and the lower inner surfaces 112 and 114 surround the base 34 with substantially flat surfaces opposing generally flat surfaces 110, 96, 98, 116 and 118 of the base for accurate positioning of the base 34. The grooves 84 and 86 and the corners 80 and 82 oppose the corners of the base 34 to lessen stress and reduce rupture of the supporting portion 14 as well as receiving displaced material from between the opposing flat positioning surfaces on the base 34 and legs 52 and 54 to permit these flat positioning surfaces to cooperate more effectively.

The forming of the grooves 84 and 86 at the junctions between the legs and the heel offers other substantial advantages in the manufacture of the slide fastener. The clamps 18 are substantially less subject to distortion during the blanking and preforming of the legs due to the reduced thickness of the portions 88 and 90; previous blanks were subject to forming "J" legs which resulted in leaks as well as rounding of the inside surfaces of the heels to reduce the accuracy of the positioning of the base relative to the clamps. Also the thinner portions 88 and 90 provide predesignated bend points in the clamps to lessen the amount of work required by the blanking machine in bending the legs 52 and 54. Furthermore, the grooving of the clamp metal results in an easier operation at the wire rolling due to the fact that the wire metal being rolled tracks easier and more accurately at the wire rolling operation because of the grooving. Further the serations are much more uniform because the grooves reduce the area which must be impressed to form the serations. The formation of the knurling or serations to a desired depth at the wire rolling is of paramount importance to securing the clamp in the final product.

Since the above described embodiment is subject to many modifications, variations and changes in detail, it is intended that all matter in the foregoing description and shown in the accompanying drawings be interpreted as illustrative and not in a limiting sense.

What is claimed is:

1. A slide fastener chain comprising a pair of rows of spaced coupling elements;

each coupling element having a shank, a head on one end of the shank for interlocking with heads of the opposite row of coupling elements, and a base on the other end of the shank forming flanges protruding perpendicularly from opposite sides of the shank;

each base defining a bottom surface, a pair of opposite outer flange edges, and upper flange surfaces disposed toward the respective head;

a pair of tape-like flexible supporting portions defining an opening therebetween and having respective inner portions folded around the bases and over the shanks of the respective rows of coupling elements with the head portions protruding from the folded portions;

a pair of rows of clamps corresponding to the coupling elements and secured on the outside of the folded portions of the supporting portions to secure the folded portions on the bases and shanks of the corresponding coupling elements;

each clamp having a heel engaging the respective folded portion against the bottom surface of the corresponding base, and having a pair of legs extending from opposite sides of the heel over opposite sides of the respectve folded portion and engaging the respective folded portion with the outer flange edges and with the opposite sides of the shank of the corresponding coupling element;

each pair of legs having respective lips extending inward toward intermediate portions of the opposite sides of the shanks, and having land areas raised toward the respective outer flange edges for positioning the corresponding clamp relative to each coupling element in directions perpendicular to the opposite sides of the shank;

each lip having a lower inner surface facing the respective upper flange surface, and each heel having a flat inner surface positioning the corresponding clamp relative to each coupling element in directions parallel to the shank; and each of said heel and said pairs of legs defining junctions therebetween having substantially reduced thickness relative to central portions of the heels and the legs forming inner corners at the junctions for receiving displaced portions of the flexible supporting portions from between the bottom surface of each base and the flat inner surface of each heel and from between the raised land areas of legs and the outer flange edges.

2. A slide fastener as claimed in claim 1 wherein each of the legs includes grooves formed in the inside surface at the junction between the heels and legs for receiving displaced portions of the flexible supporting portions.

3. A slide fastener as claimed in claim 2 wherein each of the legs includes a corner formed between the lower surface of each lip and the raised land areas to receive displaced portions of flexible supporting portions.

4. A slide fastener as claimed in claim 3 wherein each clamp includes serations extending perpendicular to the grooves on the inside surfaces of the legs and heel portions.

5. A slide fastener as claimed in claim 4 wherein the lips have serations formed in the inside surfaces thereof.

6. A method of manufacturing a slide fastener chain comprising the steps of roll forming a wire strip including forming a pair of spaced longitudinal grooves at locations corresponding to junctions between legs and opposite sides of heels of clamps, said roll forming also including forming lips on portions of the strip corresponding to inner upper portions of the legs of the clamps, and forming raised land areas on portions corresponding to intermediate portions of the legs;

stamping the roll formed wire strip and partially bending the roll formed wire strip along the grooves to form a train of partially bent clamps;

positioning coupling elements within a pair of folds in flexible supporting members defining an opening therebetween;

positioning the clamps over the outside of the folds over bases of the corresponding coupling elements;

bending the legs of the partially bent clamps inward about the junctions to engage folded portions of the supporting members on opposite sides of the bases and shanks of the coupling elements to secure the coupling elements relative to the clamps; and said clamp positioning and bending steps including positioning flat inside surfaces of the heels opposite to bottom surfaces of the bases, positioning the raised land areas of the legs opposite outer flange edges of the bases, positioning lower inner surfaces of the lips opposite upper flange surfaces of the bases, and displacing material from the supporting members into corners at the junctions between the legs and heels of the clamps.

7. A method as claimed in claim 6 wherein said roll forming also includes forming serations perpendicular to the grooves on portions corresponding to inside surfaces of the legs and the heels.

8. A method as claimed in claim 7 wherein said roll forming further includes forming corners in the leg portions adjacent the respective lips, and said clamp positioning and bending also includes displacing material from the supporting members into the corners adjacent the lips.

* * * * *